US007450087B2

(12) United States Patent
Hsu et al.

(10) Patent No.: US 7,450,087 B2
(45) Date of Patent: Nov. 11, 2008

(54) PLASMA DISPLAY PANEL, REAR SUBSTRATE AND DRIVING METHOD THEREOF

(75) Inventors: Chao-Hung Hsu, Dali (TW); Yu-Ting Chien, Yonghe (TW)

(73) Assignee: Chunghwa Picture Tubes, Ltd., Toayuan (TW)

( * ) Notice: Subject to any disclaimer, the term of this patent is extended or adjusted under 35 U.S.C. 154(b) by 689 days.

(21) Appl. No.: 10/711,576

(22) Filed: Sep. 25, 2004

(65) Prior Publication Data

US 2006/0066237 A1 Mar. 30, 2006

(51) Int. Cl.
*G09G 3/28* (2006.01)

(52) U.S. Cl. ..... 345/60; 345/37; 345/41

(58) Field of Classification Search ..... 345/60, 345/37, 41

See application file for complete search history.

(56) References Cited

U.S. PATENT DOCUMENTS 6,771,234 B2 * 8/2004 Moore ..... 345/60
7,034,443 B2 * 4/2006 Ahn et al. ..... 313/292

FOREIGN PATENT DOCUMENTS

| | | |
|---|---|---|
| JP | 2001216902 | 8/2001 |
| JP | 2006059587 | 3/2006 |
| WO | WO2004086448 | 10/2004 |

* cited by examiner

*Primary Examiner*—Richard Hjerpe
*Assistant Examiner*—Leonid Shapiro
(74) *Attorney, Agent, or Firm*—Jianq Chyun IP Office

(57) ABSTRACT

A rear substrate of plasma display panel comprises a substrate, a plurality of address electrodes, a plurality of auxiliary address electrodes, a rib and a fluorescent layer. The rib is disposed on the substrate to define a plurality of discharge spaces. Each of the address electrodes is disposed in each of the discharge spaces. The auxiliary address electrodes are disposed between the substrate and the rib. When an address signal is inputted to the address electrodes, the auxiliary address electrodes are grounded for reducing the probability of error discharge. During sustain period, the auxiliary address electrodes are coupled to a positive voltage for preventing ion bombardment of phosphors layer.

11 Claims, 6 Drawing Sheets

PLASMA DISPLAY PANEL, REAR SUBSTRATE AND DRIVING METHOD THEREOF

BACKGROUND OF THE INVENTION

1. Field of the Invention

The present invention relates to a plasma display panel (PDP), and more particularly to a PDP having auxiliary address electrodes, a rear substrate and a driving method thereof.

2. Description of Related Art

With the development of multi-media, displays serving as an interface between human and computers are more and more essential. The panel displays have substantially replaced traditional cathode-ray tube (CRT) displays. The panel displays include plasma displays, organic electro-luminescent displays (OELD) and liquid crystal displays (LCD). With advantages like big size, self-illuminance, wide-view angle, thinness and portability, and full colors, plasma displays are promising and may become the mainstream for the next generation of displays.

FIG. 1 is a schematic drawing of a prior art plasma display. Referring to FIG. 1, the prior art display panel 100 includes a front substrate 10, a rear substrate 20, X electrodes, Y electrodes, address electrodes 15 and a rib 30. The X electrodes and Y electrodes are disposed on the front substrate 10. The X electrodes and Y electrodes are covered by a dielectric layer 11 and a protection layer 12 of the front substrate 10. The address electrodes 15 and the rib 30 are disposed on the rear substrate 20. The rib 30 includes a plurality of strip patterns arranged in parallel. The stripe patterns define the rear substrate 20 into a plurality of discharge spaces 13 and electrically isolate the adjacent address electrodes 15. The discharge gases (not shown) are filled in the discharge spaces 13. A fluorescent layer 21 is coated on sidewalls of the rib 30 and portions of the substrate 10 corresponding to the discharge spaces 13. The areas between the X and Y electrodes, which correspond to the address electrodes 15, represent the pixel areas of the plasma display panel 100.

By applying scanning signals on the X electrodes, Y electrodes and the address electrodes 15, plasma is generated in each of the discharge spaces 13. The fluorescent material layer 21 is exposed to ultraviolet (UV) light generated from the plasma. Accordingly, the plasma display panel 100 displays an image.

Each pair of the X and Y electrodes is arranged in row direction, and each of the address electrodes 15 are arranged in column direction. When address signals are inputted to one of the address electrodes 15, the electrical field distributed in the discharge spaces corresponding to the adjacent address electrodes 15 is easy to be affected. Due to the affection, error discharge may occur at the adjacent pixels.

SUMMARY OF THE INVENTION

Accordingly, the present invention is directed to a rear substrate of a plasma display panel, adapted to reduce the probability of error discharge.

The present invention is directed to a driving method of a plasma display panel, adapted to reduce the probability of error discharge so that the probability of bombardment by ions on the fluorescent layer is substantially reduced, and the lifetime of the panel is extended.

The present invention discloses a rear substrate of a plasma display panel. The rear substrate comprises a substrate, a plurality of address electrodes, a rib, a plurality of auxiliary address electrodes and a fluorescent material layer. The rib and the address electrodes are disposed on the substrate. The rib also defines a plurality discharge spaces on the substrate. Each of the address electrodes is disposed in one of the discharge spaces respectively. The auxiliary address electrodes are disposed between the rib and the substrate. The fluorescent material layer is coated on sidewalls of the rib and portions of the substrate corresponding to the discharge spaces.

The present invention discloses a plasma display panel. The plasma display panel comprises a rear substrate, discharge gas and a front substrate. The rear substrate comprises a first substrate, a plurality of address electrodes, a rib, a plurality of auxiliary address electrodes and a fluorescent material layer. The rib and the address electrodes are disposed on the substrate. The rib also defines a plurality discharge spaces on the substrate. Each of the address electrodes is disposed in one of the discharge spaces respectively. The auxiliary address electrodes are disposed between the rib and the substrate. The fluorescent material layer is coated on sidewalls of the rib and portions of the substrate corresponding to the discharge spaces. The front substrate is disposed over the rear substrate. The front substrate comprises a second substrate and a plurality of pairs of electrodes. These pairs of electrodes are located on the second substrate and between the second substrate and the rear substrate. The discharge gas is disposed between the front substrate and the rear substrate.

According to an embodiment of the present invention, the auxiliary address electrodes can be, for example, grounded or coupled to a positive voltage terminal. The rib comprises, for example, a plurality of stripe patterns. The stripe patterns, for example, are parallel to each other.

According to an embodiment of the present invention, the front substrate further comprises a dielectric layer and a protection layer, wherein the dielectric layer is disposed on the second substrate covering the pairs of electrodes, and the protection layer is disposed on the dielectric layer. The protection layer can be, for example, magnesium oxide.

According to an embodiment of the present invention, each of the pairs of electrodes comprises, for example, an X electrode and a Y electrode. The pairs of electrodes parallel to each other. The extended direction of the X electrode and the extended direction of the Y electrode, for example, are not parallel to the extended direction of the address electrodes, or are orthogonal to the extended direction of the address electrodes.

The present invention also discloses a driving method of a plasma display panel, adapted to drive the plasma display panel described above. First, the address electrodes and the pairs of electrodes are reset, then the auxiliary address electrodes are electrically grounded. Then, a scanning signal is applied to the pairs of electrodes and an address signal is input to the address electrodes. When inputting a sustain signal to the address electrodes and the pairs of electrodes, the auxiliary address electrodes are electrically floated or coupled to a positive voltage terminal.

According to an embodiment of the present invention, after sustaining the pairs of electrodes, the above steps are repeated at least once.

The present invention applies auxiliary address electrodes between the address electrodes to reduce the probability of error discharge. Using the rib as a protection layer for the auxiliary address electrodes can reduce the damage for the auxiliary address electrodes during discharge. The auxiliary address electrodes and the address electrodes of the present invention are coupled to a positive voltage during sustaining.

The probability of bombardment by positive ions on the fluorescent material layer, and the lifetime of the plasma display panel is extended thereby.

In order to make the aforementioned and other objects, features and advantages of the present invention understandable, a preferred embodiment accompanied with figures is described in detail below.

DESCRIPTION OF EMBODIMENTS

Figure 1:
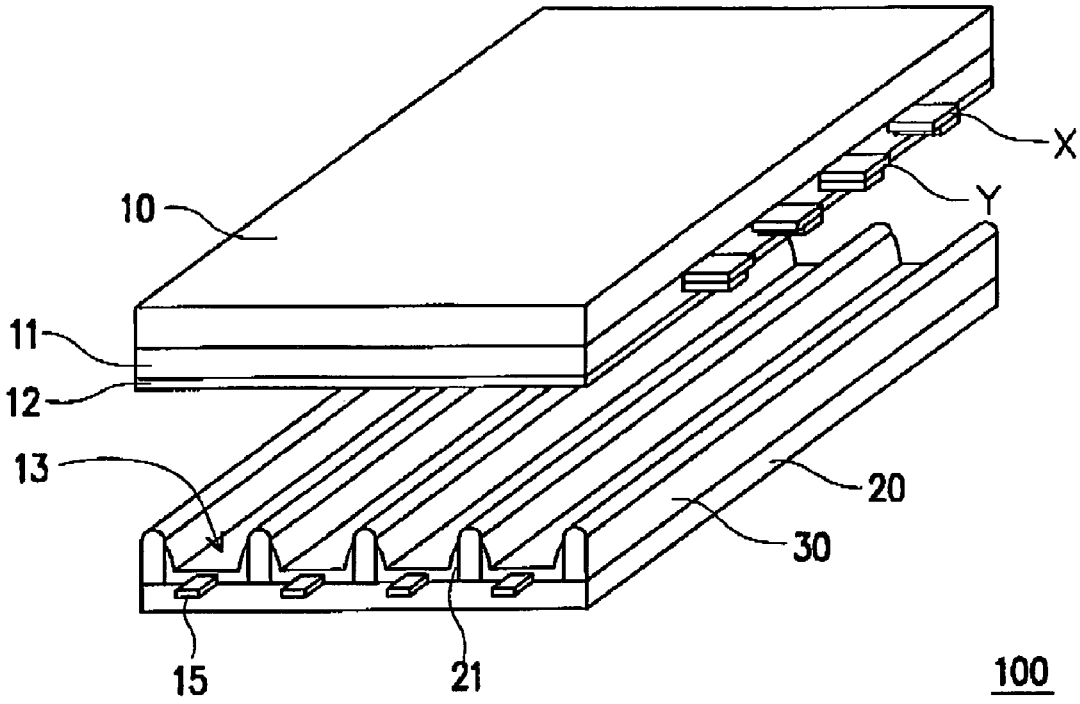
FIG. 1 (PRIOR ART)
FIG. 1 is a schematic drawing of a prior art plasma display.
Figure 2:
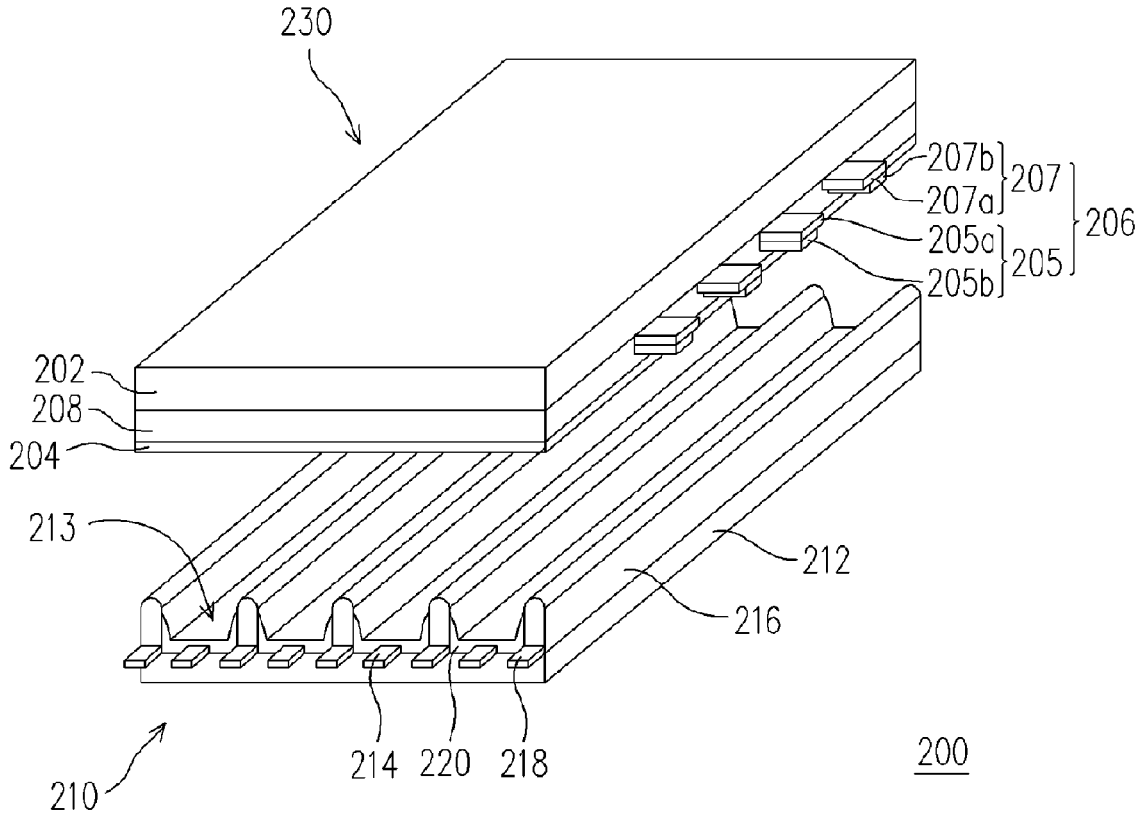
FIG. 2 is a schematic drawing of a plasma display panel according to an embodiment of the present invention.

FIG. 2 is a schematic drawing of a plasma display panel according to an embodiment of the present invention. Referring to FIG. 2, the plasma display panel 200 comprises a rear substrate 210 and a front substrate 220. The rear substrate 210 comprises a first substrate 212, address electrodes 214, a rib 216, auxiliary address electrodes 218 and a fluorescent material layer 220. The rib 216 and the address electrodes 214 are disposed on the substrate 212. The rib 216 also defines a plurality discharge spaces 213 on the substrate 212. Each of the address electrodes 214 is disposed in one of the discharge spaces 213 respectively. In this embodiment, the rib 216 comprises, for example, a plurality of stripe patterns that parallel to each other. Each of the strip patterns is disposed between two adjacent address electrodes 214 as shown in FIG. 2.

The auxiliary address electrodes 218 are stripe electrodes disposed between the rib 216 and the substrate 212. In other words, each of the auxiliary address electrodes 218 is disposed between two adjacent address electrodes 214. The auxiliary electrodes 218 are covered by the rib 216. Electrically coupling of the auxiliary address electrodes 218 to a particular voltage terminal depends on the driving scheme of the plasma display panel 200. Detailed descriptions will be explained later. The fluorescent material layer 220 is coated on sidewalls of the rib 216 and portions of the first substrate 212 corresponding to the discharge spaces 213 to cover the address electrodes 214. The fluorescent material layer 220 comprises, for example, fluorescent materials that illuminate red, green and blue lights.

The front substrate 230 comprises a second substrate 202, pairs of electrodes 206, a dielectric layer 208 and the protection layer 204. The pairs of electrodes 206 are disposed on the second substrate 202. The dielectric layer 208 and the protection layer 204 disposed thereon covers the pairs of electrodes 206 for protecting the pairs of electrodes 206 from damage during discharge. The material of the protection layer 204 may comprise, for example, magnesium oxide.

In this embodiment, each of the pairs of electrodes 206 comprises, for example, an X electrode 205 and a Y electrode 207 are disposed parallel to each other. The extended direction of the X electrode 205 and the extended direction of the Y electrode 207 are not parallel to the extended direction of the address electrodes 214, or are orthogonal thereto. The electrode 205 comprises, for example, a transparent electrode 205*a* and a bus electrode 205*b*. The Y electrode 207 comprises, for example, a transparent electrode 207*a* and a bus electrode 207*b*. The transparent electrodes 205*a*, 207*a* can be made of, for example, indium-tin oxide (ITO) or the other transparent electrode material. The bus electrodes 205*b*, 207*b* can be made of, for example, low-resistance metal and disposed on the transparent electrodes 205*a* and 207*a*, respectively, for reducing the resistance of the X electrode 205 and the Y electrode 207.

In this embodiment, discharge gases (not shown) are filled in the discharge spaces defined by the rib 216. When a scanning signal is applied to the X electrode 205 and the Y electrode 207, and an address signal is inputted to an address of the address electrodes 214, plasma is generated in each of the discharge spaces 213. The fluorescent material layer 220 is exposed to ultraviolet (UV) light generated from the plasma. Accordingly, the plasma display panel displays an image.

Figure 3A:
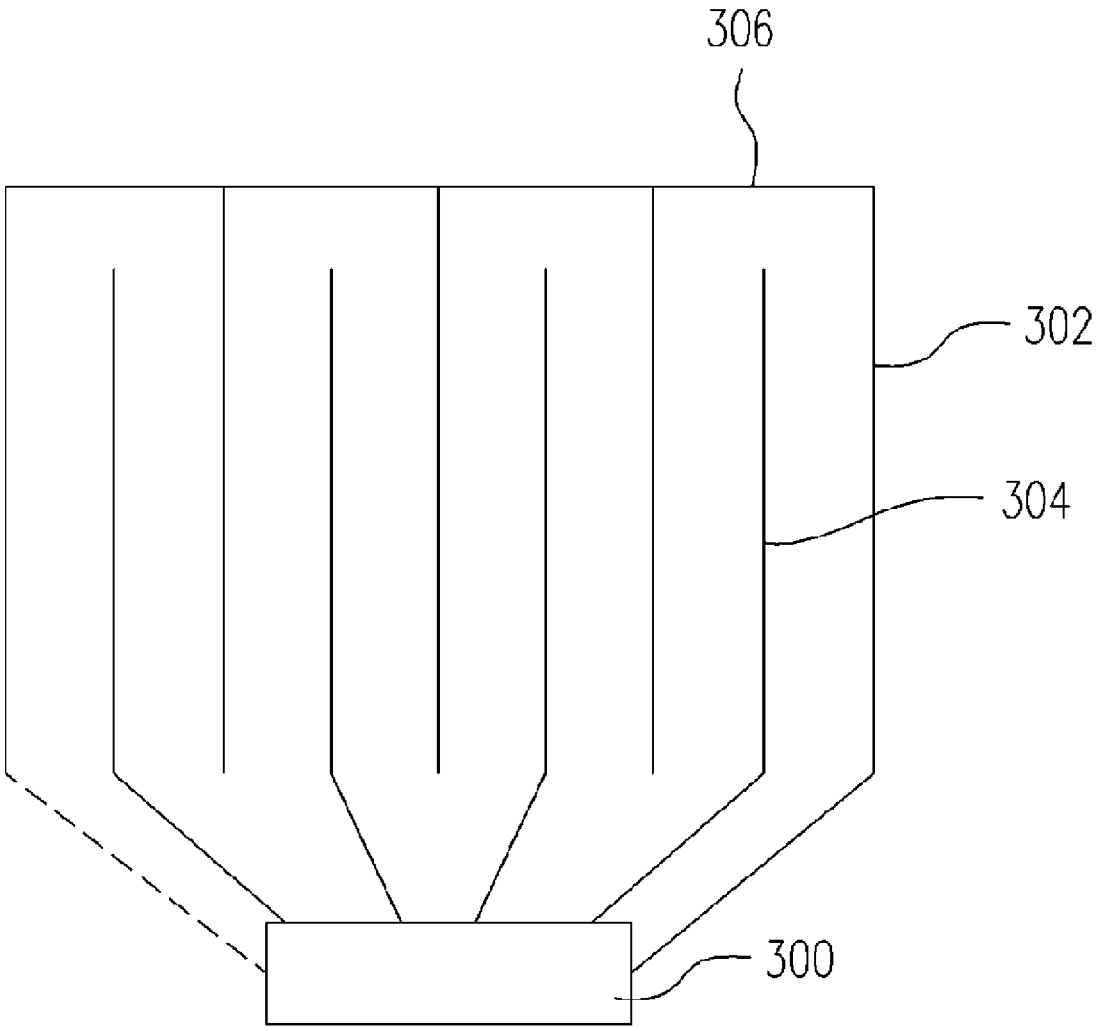
FIGS. 3A and 3B are schematic layouts of auxiliary address electrodes and address electrodes according to various embodiments of the present invention.
Figure 3B:
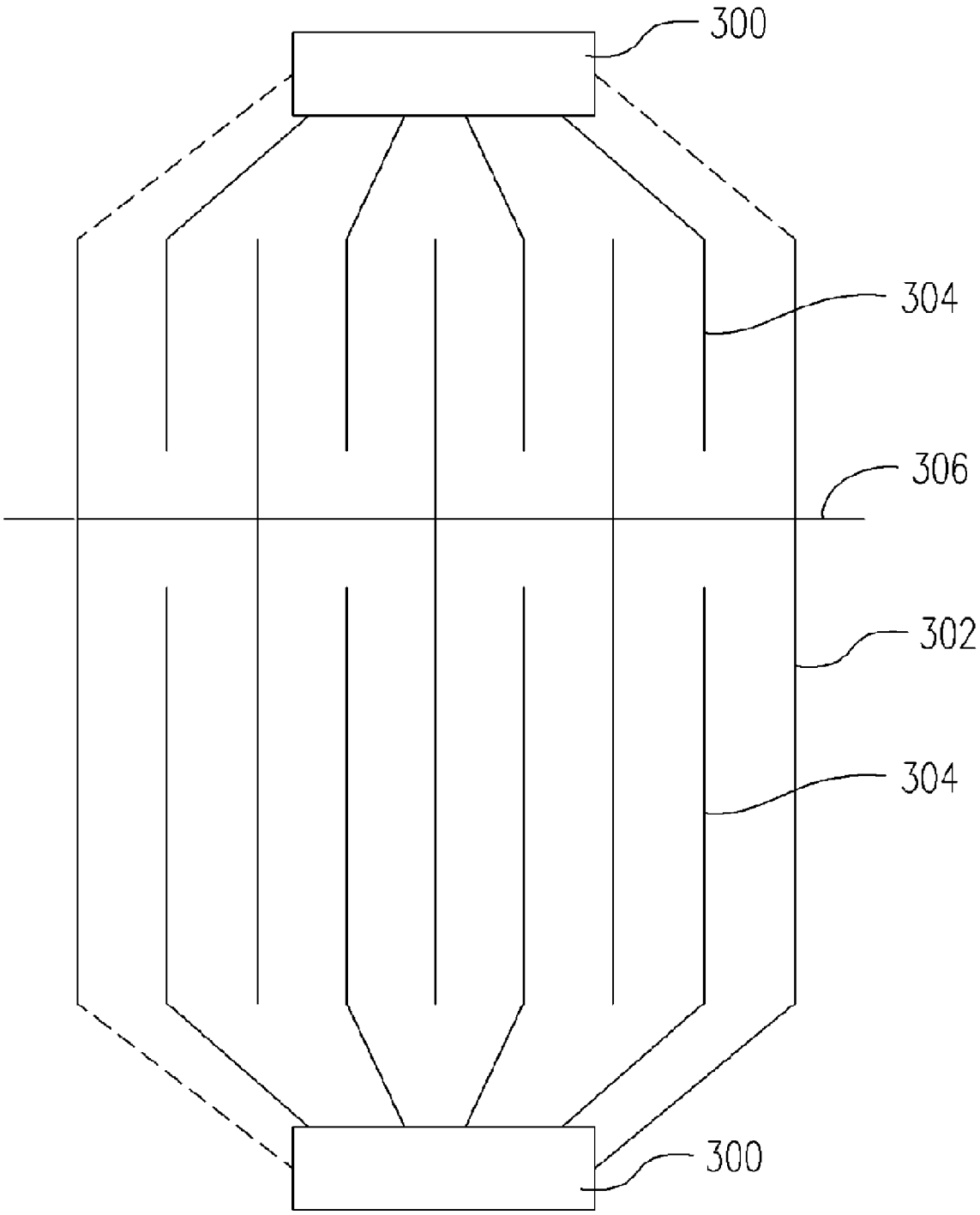

A variety of layouts of the auxiliary address electrodes and the address electrodes can be applied. For example, a terminal of each of the auxiliary address electrodes 302 can be coupled to each other via a conductive line 306 as shown in FIG. 3A. At least one of the auxiliary address electrodes 302 is then coupled to an external circuit 300 via any one of the auxiliary address electrode 302. In another embodiment, the auxiliary address electrodes 302 are coupled to each other via a conductive line 302 crossing thereover as shown in FIG. 3B. At least one of the auxiliary address electrodes 302 is then coupled to an external circuit 300 via any one of the auxiliary address electrode 302. In the latter embodiment in which the conductive line 306 cross over the auxiliary address electrodes 302, each of the address electrodes 304 are divided thereby and separately coupled to the external circuits 300 as shown in FIG. 3B.

The layouts of the auxiliary address electrodes and the address electrodes described above are exemplary. The present invention is not limited thereto. One of ordinary skill in the art can modify the invention according to these embodiments. Such modification still falls within the scope of the present invention.

Following are the descriptions of a driving method of the plasma display panel 200 of FIG. 2 according to the present invention. The driving method of the present invention, however, is not limited thereto. Any plasma display panel with the auxiliary address electrodes according to the present invention can adopt the driving method.

Figure 4:
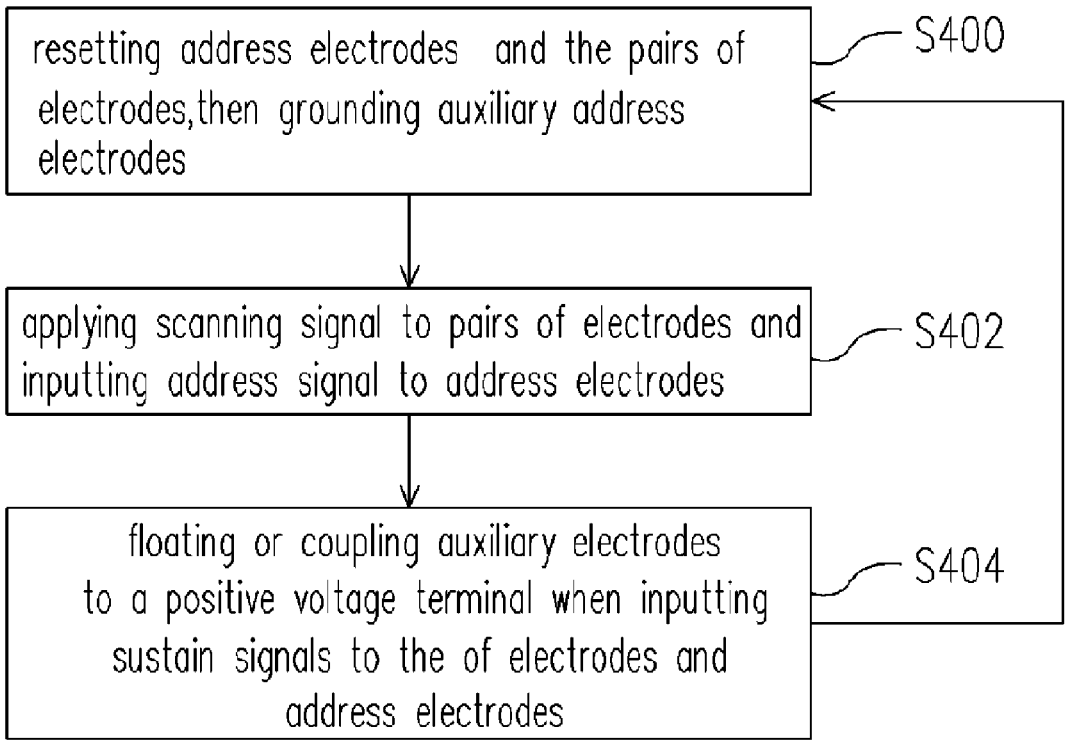
FIG. 4 is a flowchart of a driving method of a plasma display panel according to an embodiment of the present invention.

FIG. 4 is a flowchart of a driving method of a plasma display panel according to the present invention. Referring to FIGS. 2 and 4, at step S400, the pairs of electrodes 206 and the address electrodes 214 are reset, then the auxiliary address electrodes 218 are grounded. According to the addresses of pixels to be activated, a scanning signal is applied to the corresponding pair of electrodes 206 and address signal are inputted to the corresponding address electrodes 214 as shown at step S402.

At step S404, when inputting sustain signals to the pairs of electrodes 206 and the address electrodes 214, the auxiliary address electrodes 218 are electrically coupled to a positive voltage terminal or electrically floated. The auxiliary address electrodes 218 and the address electrodes 214 of the present invention are coupled to a positive voltage during discharge sustaining. Therefore, the damage of the luminescent material layer 220 caused by the bombardment of positive ions on the address electrodes 214 can be reduced for extending the life time of the plasma display panel 200. The steps S400-S404 are repeated for the operating the plasma display panel 200.

Figure 5:
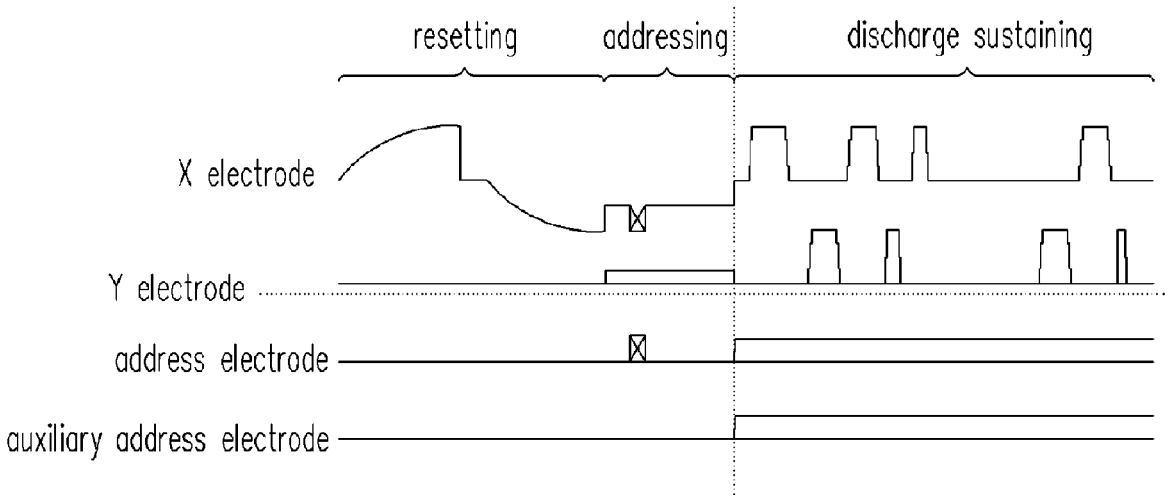
FIG. 5 is schematic waveforms of operation of a plasma display panel according to an embodiment of the present invention.

When resetting the pairs of electrodes 206 and the address electrodes 214, the auxiliary address electrodes 218 should be grounded. In other words, except during discharge sustaining, the auxiliary address electrodes 218 are grounded for reducing cross-talk and the probability of error discharge from occurring at adjacent pixels. FIG. 5 is schematic waveforms of operation of a plasma display panel according to an embodiment of the present invention.

Accordingly, the present invention disposes the auxiliary address electrode between the address electrodes. When the address signal is inputted to the address electrodes, the auxiliary address electrodes are grounded for reducing the probability of error discharge from occurring at adjacent pixels. The auxiliary address electrodes and the address electrodes can be fabricated in one process. The plasma display panel of the present invention, therefore, does not complicate the manufacturing process thereof. In addition, the auxiliary address electrodes are disposed between the rib and the substrate. The rib protects the auxiliary address electrodes from damage caused by discharge.

When inputting sustain signal to the activated pixels, the auxiliary address electrodes are electrically floated or coupled to a positive voltage terminal. Accordingly, the bombardment by positive ions on the fluorescent material layer on the address electrodes can be reduced thereby. The lifetime of the plasma display panel is, therefore, extended.

Although the present invention has been described in terms of exemplary embodiments, it is not limited thereto. Rather, the appended claims should be constructed broadly to include other variants and embodiments of the invention which may be made by those skilled in the field of this art without departing from the scope and range of equivalents of the invention.

What is claimed is:

1. A plasma display panel, comprising:

a rear substrate comprising:

a first substrate;

a plurality of address electrodes, disposed on the substrate;

a rib, disposed on the substrate defining a plurality of discharge spaces, each of the address electrodes disposed in one of the discharge spaces;

a plurality of auxiliary address electrodes disposed between the rib and the substrate, wherein the address electrodes and the auxiliary address electrodes are arranged on the first substrate alternately such that each of the address electrodes is located under one of the discharge space respectively;

a fluorescent material layer disposed on sidewalls of the rib and portions of the substrate corresponding to the discharge spaces covering the address electrodes;

a front substrate disposed above the rear substrate, comprising:

a second substrate;

a plurality of pairs of electrodes, disposed on the second substrate, wherein the pairs of electrodes are located between the second substrate and the rear substrate; and discharge gas disposed in the discharge spaces.

2. The plasma display panel of claim 1, further comprising a dielectric layer and a protection layer, wherein the dielectric layer is disposed on the second substrate covering the pairs of electrodes, and the protection layer is disposed on the dielectric layer.

3. The plasma display panel of claim 2, wherein a material of the protection layer comprises magnesium oxide.

4. The plasma display panel of claim 1, wherein the auxiliary address electrodes are grounded, floating or coupled to a positive voltage terminal.

5. The plasma display panel of claim 1, wherein the rib comprises a plurality of strip patterns.

6. The plasma display panel of claim 5, wherein the strip patterns parallel to each other.

7. The plasma display panel of claim 1, wherein the pairs of electrodes parallel to each other, and an extended direction of the pairs of electrodes are different from an extended direction of the address electrodes.

8. The plasma display panel of claim 7, wherein the extended direction of the pairs of electrodes is orthogonal to the extended direction of the address electrodes.

9. The plasma display panel of claim 1, wherein each of the pairs of electrodes comprises an X electrode and a Y electrode.

10. A driving method of a plasma display panel adapted to drive the plasma display panel as claimed in claim 1, the driving method comprising:

(a) resetting the address electrodes and the pairs of electrodes , then electrically grounding the auxiliary address electrodes;

(b) applying a scanning signal to the pairs of electrodes, and inputting an address signal to the address electrodes; and (c) electrically floating the auxiliary address electrodes or coupling the auxiliary address electrodes to a positive voltage terminal when inputting sustain signals to the address electrodes and the pairs of electrodes.

11. The driving method of claim 10, after resetting the address electrodes and the pairs of electrodes, further comprising repeating the steps (a) to (c) at least once.

* * * * *